US007500918B2

(12) United States Patent
Zennyoji

(10) Patent No.: US 7,500,918 B2
(45) Date of Patent: Mar. 10, 2009

(54) SHAFT MEMBER PROVIDED WITH A PLURALITY OF RIDGES ON AN OUTER CIRCUMFERENTIAL SURFACE THEREOF

(75) Inventor: Mamoru Zennyoji, Tochigi-ken (JP)

(73) Assignee: Mitsuba Corporation, Gunma (JP)

( * ) Notice: Subject to any disclaimer, the term of this patent is extended or adjusted under 35 U.S.C. 154(b) by 189 days.

(21) Appl. No.: 11/092,105

(22) Filed: Mar. 29, 2005

(65) Prior Publication Data

US 2005/0217338 A1 Oct. 6, 2005

(30) Foreign Application Priority Data

Mar. 31, 2004 (JP) ..... 2004-101995

(51) Int. Cl.
*F16C 3/00* (2006.01)

(52) U.S. Cl. ..... 464/182; 403/359.6

(58) Field of Classification Search ..... 403/298, 403/359.4, 359.5, 359.6, 356, 358, 359.3; 464/182, 74, 162; 310/75 R, 79; 29/597, 29/598, 893.35

See application file for complete search history.

(56) References Cited

U.S. PATENT DOCUMENTS 1,025,278 A * 5/1912 Kirchhoff ..... 403/358
1,586,990 A * 6/1926 Harrison ..... 403/359.6 X
2,733,082 A * 1/1956 Backhouse ..... 403/356
3,269,204 A * 8/1966 Schleicher, Jr. ..... 310/75 R X
3,436,106 A * 4/1969 Luenberger ..... 403/356
3,517,953 A * 6/1970 Barbee et al. ..... 403/359.3 X
4,182,193 A * 1/1980 Schultz, Jr. ..... 403/359.6 X
4,216,575 A * 8/1980 Carnavos et al. ..... 29/597
5,437,351 A * 8/1995 Lindner ..... 403/359.5 X
6,244,964 B1 * 6/2001 Kirschey ..... 464/74

FOREIGN PATENT DOCUMENTS

JP 05-200475 8/1993
JP 07-259872 10/1995

* cited by examiner

*Primary Examiner*—Greg Binda
(74) *Attorney, Agent, or Firm*—Marshall & Melhorn LLC

(57) ABSTRACT

A plurality of axial grooves are formed on the outer circumferential surface of a shaft member by applying an arcuate edge defined between an end surface and outer circumferential surface of a rotatable cylindrical forming tool having a generally smooth surface. Typically, the rotational center of the forming tool is tilted backward as it is moved along the length of the shaft member. Owing to the plastic flow of the material of the shaft member, a pair of ridges are formed on either side of the groove. The end surface of the forming tool causes a more pronounced plastic flow than the outer circumferential surface of the forming tool so that one of the ridges is greater in height and higher in hardness than the other. This provides various benefits when this shaft member is press fitted into a bore of an armature core or the like.

8 Claims, 5 Drawing Sheets

SHAFT MEMBER PROVIDED WITH A PLURALITY OF RIDGES ON AN OUTER CIRCUMFERENTIAL SURFACE THEREOF

TECHNICAL FIELD

The present invention relates to a method for forming a plurality of longitudinal ridges on the surface of a shaft member for press fitting the shaft member into a bore of another component such as an armature core and commutator in a rotationally fast manner, and a shaft member provided with a plurality of longitudinal ridges having a desirable configuration on an outer surface thereof.

BACKGROUND OF THE INVENTION

The shaft of an armature core is typically press fitted into the central bore of the armature core of an electric motor. To ensure a rotationally fast engagement between the shaft and armature core, it is commonly practiced to form a plurality of longitudinal ridges on the outer circumferential surface of the shaft before press fitting the shaft into the central bore of the armature core.

According to a known method for forming such ridges on a shaft, a tool in the form of a metallic die is pressed upon the shaft between an upper and lower die assembly such that an edge of the metallic die forms a groove in the surface of the shaft by plastic deformation. This causes a plastic flow of the material of the shaft such that a ridge is formed on either side of the groove (See Japanese patent laid-open publication No. H05-200475).

However, this known method has the following disadvantages.

(1) A relatively large force has to be applied to the forming tools to produce ridges having a desired height, and the resulting residual stress is so great that the circularlity of the shaft may be impaired. Therefore, the centering precision in press fitting the shaft into the bore of a motor armature core or commutator cannot be made so high as desired.

(2) The tops of the produce ridges are relatively blunt, and there is almost no work hardening. Therefore, the engagement between the shaft and the bore of a motor armature core or commutator cannot be made so secure as desired.

(3) Because the axial length of each ridge is determined by the length of the tool, different tools are required for the different specifications of the motor shafts. Therefore, a large number of tools are needed when there are a large number of models and the production volume of each model is small. This results in a high manufacturing cost.

(4) A press of a large capacity typically in the order of 10-ton is required, and this requires a high initial cost.

BRIEF SUMMARY OF THE INVENTION

In view of such problems of the prior art, a primary object of the present invention is to provide a method for forming a plurality of axial ridges on the outer circumferential surface of a shaft member.

A second object of the present invention is to provide a method for forming a plurality of ridges on the outer circumferential surface of a shaft member in such a manner that allows each ridge to be provided with a pointed top and a high hardness.

A third object of the present invention is to provide a method for forming a plurality of axial ridges on the outer circumferential surface of a shaft member which is economical to implement.

A fourth object of the present invention is to provide a method for forming a plurality of axial ridges on the outer circumferential surface of a shaft member which is highly efficient.

A fifth object of the present invention is to provide a shaft member formed with a plurality of axial ridges which are high in hardness and provided with pointed tops on the outer circumferential surface thereof.

According to the present invention at least some of these objects and other objects can be accomplished by providing a method for forming a plurality of longitudinal ridges on a surface of a shaft member, comprising the steps of: rotatably supporting a cylindrical tool having an arcuate edge defined between an axial end surface and an outer circumferential surface thereof around an axial line thereof, the cylindrical tool having a relatively smooth surface in a part defining the edge; supporting a shaft member so as to be relatively moveable in an axial direction thereof; and applying the edge of the cylindrical tool to the shaft member while relatively moving the shaft member in the axial direction thereof.

The shaft member fabricated by performing this method is provided with a plurality of axial grooves formed on an outer circumferential surface of the shaft member at a regular circumferential spacing, each groove having a V-shaped cross section; a first ridge formed on a first side of each axial groove; and a second ridge formed on a second side of the axial groove opposite to the first side; wherein the first ridge has a greater overall height than the second ridge.

The end surface of the forming tool causes a more pronounced plastic flow than the outer circumferential surface of the forming tool so that the first ridges are greater in height and higher in hardness than the second ridges. Therefore, when this shaft member is inserted in a bore of a component such as an armature core, the second ridges provide a guide action while the first ridges cut into the material of the component so that a secure engagement can be achieved between the shaft member and component. In particular, because of the enhanced work hardening that takes place in forming the first ridges, the first ridges are typically provided with a higher hardness, and this contributes to the secure engagement between the shaft member and component, and reduces the force required to press fit the shaft member into the bore of the component.

Preferably, the axial line of the cylindrical tool is tilted by a prescribed angle relative to a plane perpendicular to the axial direction of the shaft member in the axial direction of the shaft member. For instance, the cylindrical tool may be tilted backward with respect to the axial direction. Thereby, the second ridge is given a gradually increasing height from an axial end thereof in such a manner that the second ridge has a greater height than the first ridge only in an axial end region thereof. According to this embodiment, the centering action of the second ridge is particularly enhanced.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
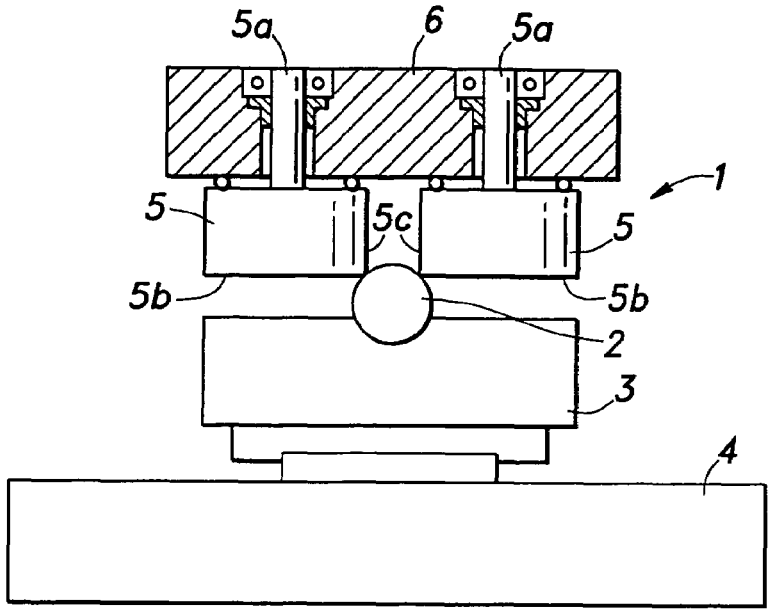
FIG. 1 is a front view of the ridge forming device suitable for implementing the method of the present invention.
Figure 2:
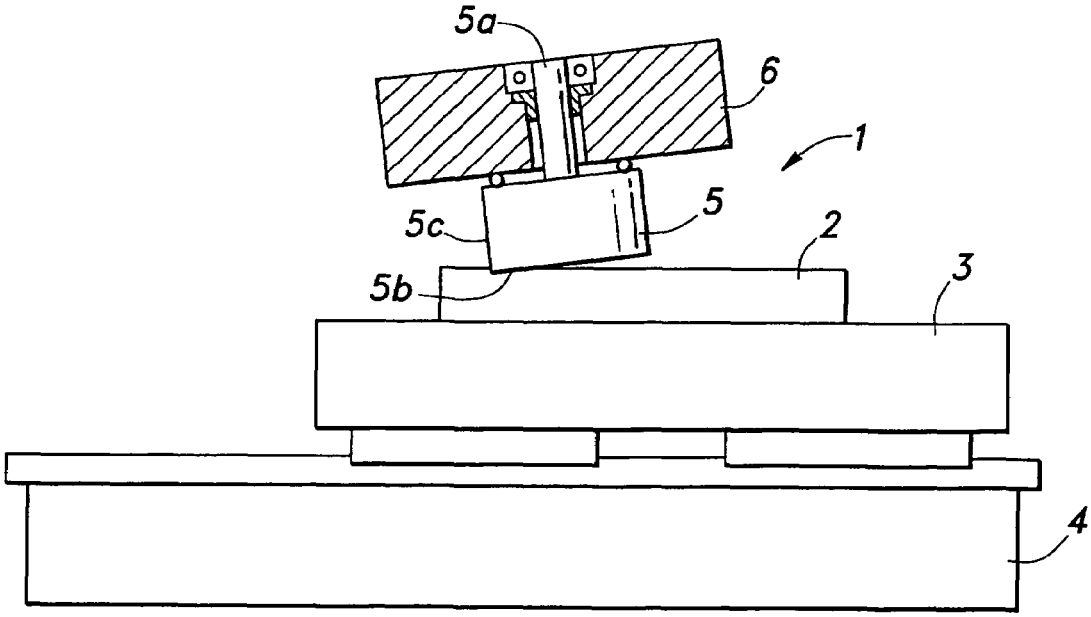
FIG. 2 is a side view of the ridge forming device.

FIGS. 1 and 2 show a ridge forming device suitable for implementing the method of the present invention. This device 1 comprises a work support table 3 that supports a work piece 2 (consisting of a motor shaft) in a horizontal orientation, a fixed table 4 for supporting the work support table 3 so as to be moveable in the axial direction of the work piece 2, a pair of cylindrical forming tools 5 engaging the outer surface of the work piece 2 at edges 5*a* thereof as they rotate, and a tool support table 6 for supporting the forming tools 5 in a rotatable manner. Each forming tool 5 is provided with a generally smooth and hard surface, and defines the edge 5*a* between the outer circumferential surface 5*c* and axial end surface 5*b* thereof.

The tool support table 6 is moveable in the axial direction of the work piece 2 relative to the fixed table 4, and is also moveable in the vertical direction so as to press the forming tools 5 against the work piece 2 at a desired load. The forming tools 5 are rotatably supported by the tool support table 6 via support shafts 5*a*. As best shown in FIG. 2, the tool support table 6 can also be tilted in the axial direction of the work piece 2.

Figure 7:
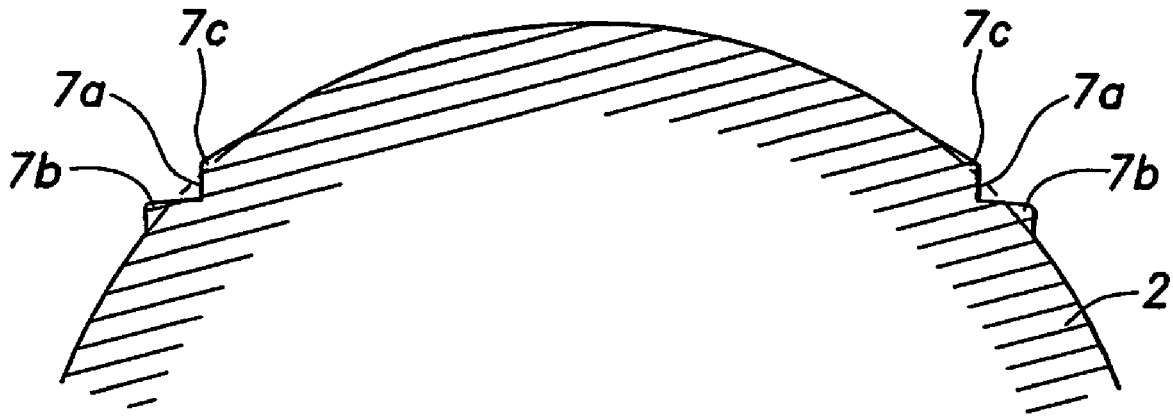
FIG. 7 is an enlarged cross sectional view, taken at the line 3-3 of FIG. 5 and showing a pair of grooves as shown being formed in FIG. 1.

By applying the forming tools 5 against the surface of the work piece 2 and moving the tool support table 6 along the length of the work piece 2 so as to cause each tool 5 to roll over the surface of the work piece 2, at the same time as a groove 7*a* is formed by each forming tool 5 on the surface of the work piece 2, a pair of ridges or a first ridge 7*b* and a second ridge 7*c* are formed on either side of the groove 7*a* (See FIG. 7). As best shown in FIG. 2, the forming tools 5 are tilted in a rearward direction with respect to the direction in which the forming tools 5 are moved along the length of the work piece 2. This tilting angle is typically in the range of 1.5 to 3 degrees. The rotational centerline of each tool 5 tilts rearward in the illustrated embodiment, but may also be tilted forward.

Figure 3:
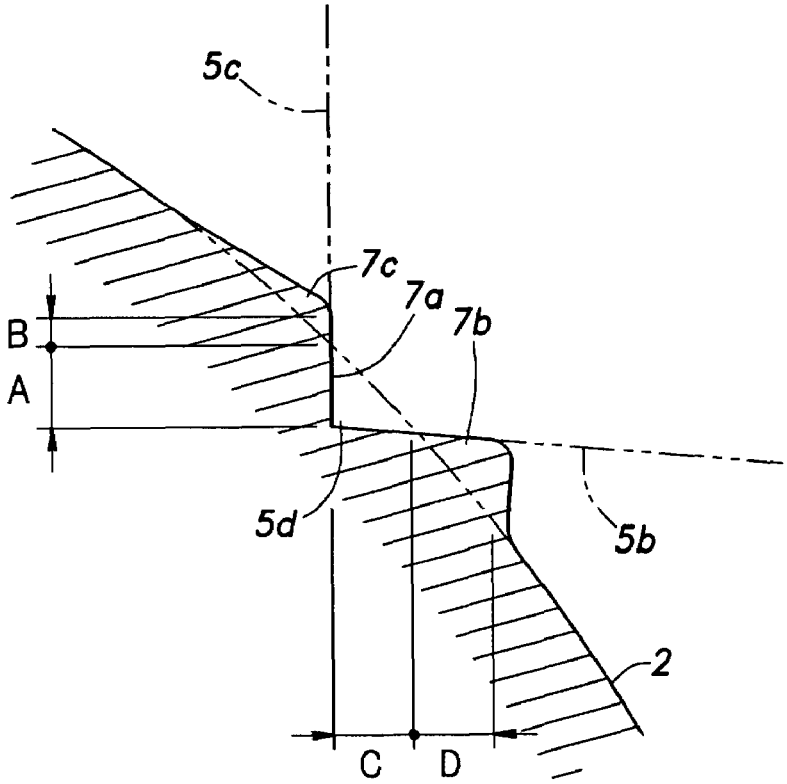
FIG. 3 is an enlarged cross sectional view of the work piece taken along the line 3-3 in FIG. 5 showing the ridges formed according to the present invention.
Figure 4:
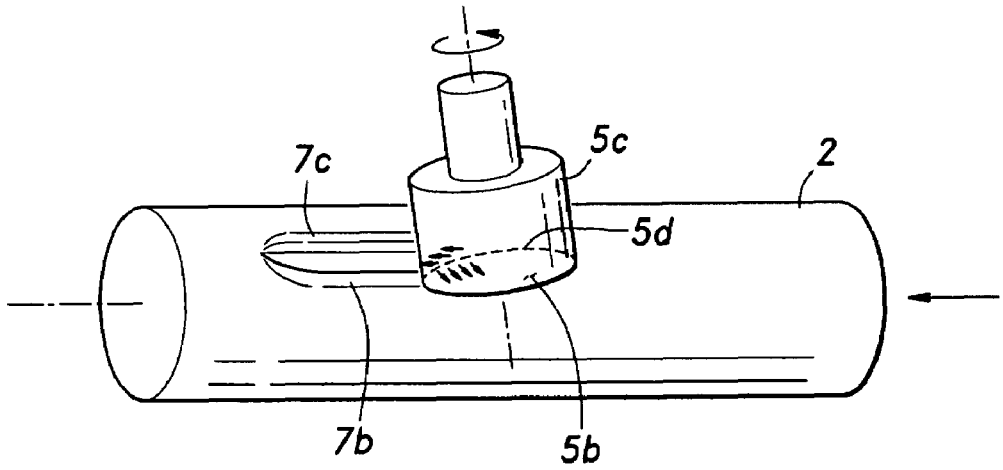
FIG. 4 is a perspective view showing how the ridges are formed.

FIG. 3 is a cross sectional view of the work piece 2 taken along a plane perpendicular to an axis of the work piece 2 showing the groove 7*a* and ridges 7*b*, 7*c* formed in the work piece 2. Each forming tool 5 engages the work piece 2 at the arcuate edge 5*d* defined between the axial end surface 5*b* and cylindrical outer circumferential surface 5*c* thereof, and this edge 5*d* produces the V-shaped groove 7*a* having an opening angle of about 90 degrees or greater.

The outer circumferential surface 5*c* of each forming tool 5 primarily rolls over the corresponding side wall of the groove 7*a* substantially without slipping. However, because of the slightly skewed relationship between the cylindrical outer surface 5*c* of the tool 5 and the work piece 2 owing to the tilting of the rotational center line of the forming tool 5 with respect the axial direction of the work piece 2, slight sliding movement between them is inevitable. The rotational center line tilts rearward with respect to the direction of relative motion between the forming tool 5 and work piece 2.

Owing to the compressive force applied by the outer circumferential surface 5*c* of each forming tool 5 to the material of the work piece 2, combined with the rubbing movement of the forming tool 5 against the work piece 2 owing to the tilting of the rotational center line of the forming tool 5, the material of the work piece 2 undergoes a plastic flow that eventually forms the second ridge 7*c* on the corresponding side of the groove 7*a*. As seen in cross section, the peak of this ridge 7*c* defines a relatively blunt angle which is substantially greater than 90 degrees, and the ridge 7*c* continues to the adjoining surface of the work piece 2 in a relatively smooth fashion. Typically, the projecting height B of the second ridge 7*c* from the outer circumferential surface of the work piece 2 is smaller than the length A of the corresponding side wall of the V-groove 7*a* (A>B), as measured along this side wall of the V-groove 7*a*.

The axial end surface 5*b* of the forming tool 5, on the other hand, more vigorously rubs against the corresponding side wall of the groove 7*a*. In particular, the axial end surface 5*b* of the forming tool 5 rubs the side wall upward so that a pronounced plastic flow of the material in the upward direction is produced. As a result, the first ridge 7*b* is formed on the corresponding side of the groove 7*a*, and this first ridge 7*b* is somewhat greater in height than the second ridge 7*c* on the other side of the groove 7*a*. Typically, the projecting height D of the first ridge 7*b* from the outer circumferential surface of the work piece 2 is equal to or greater than the length C of the corresponding side wall of the V-groove 7*a* ($D \geqq C$), as measured along this side wall of the V-groove 7*a*. The peak of the first ridge 7*b* defines an angle of about 90 degrees or smaller, and this ridge 7*b* relatively sharply rises from the adjoining surface of the work piece 2 as seen in cross section. Furthermore, the plastic flow of the material is so substantial in this case that the hardness of the first ridge 7*b* increases to a significant extent because of work hardening, and is greater than that of the second ridge 7*c*. Typically, a hardness of 300 Hv can be achieved in the first ridge 7*b*.

The ridges 7*b* and 7*c* having different heights are thus produced on either side of the groove 7*a*, and this owes to the fact that the groove 7*a* is formed by the arcuate edge 5*d* defined between the outer circumferential surface 5*c* and axial end surface 5*b* of the forming tool 5.

Figure 5:
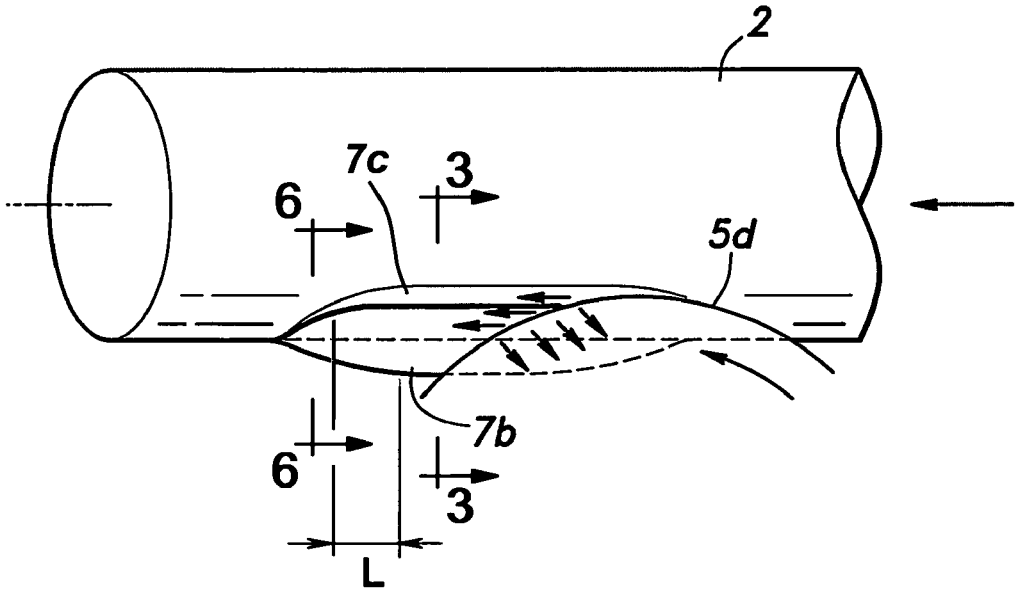
FIG. 5 is a side view showing how the ridges are formed.
Figure 6:
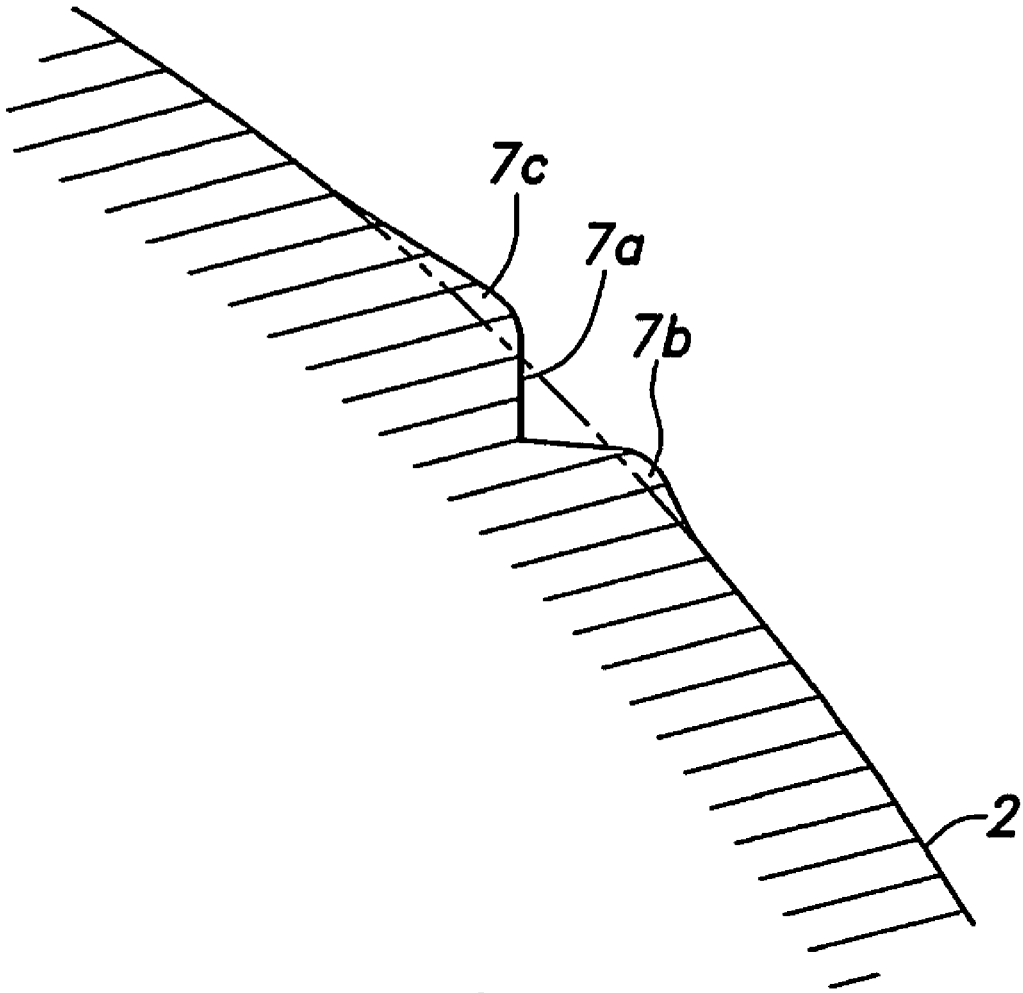
FIG. 6 is an enlarged cross sectional view taken along the line 6-6 in FIG. 5.

Because the forming tools 5 are tilted (by 1.5 to 3 degrees) with respect to the line vertical to the axial line of the work piece 2, the opening angle of the groove 7*a* is somewhat greater than 90 degrees. Also, owing to the tilting of the forming tools 5, the starting end of the second ridge 7*c* formed by the outer circumferential surface 5*c* of the forming tool 5 is located somewhat ahead of the starting end of the first ridge 7*b* formed by the axial end surface 5*b* of the forming tool 5, as indicated by dimension L in FIG. 5. In other words, the second ridge 7*c* has a gradually increasing height from an axial end thereof, and has a greater height than the first ridge 7*b* only in an axial end region thereof (see FIG. 6). Therefore, the second ridges 7*c* are pushed into the bore of the armature core before the first ridges 7*b*, and this ensures a precise centering of the motor shaft and reduces the resistance to the press fitting of the motor shaft into the bore of the armature core.

When this shaft is press fitted into a central bore of an armature core, the second ridges provides a centering action for the motor shaft relative to the bore of the armature core without causing any significant deformation to the armature core. The first ridges on the other hand cut into the material of the inner wall of the bore of the armature core, and cause a secure engagement between the motor shaft and armature core. Owing to the centering action of the second ridges 7*c*, the first ridges 7*b* are allowed to cut into the material of the armature core in a relatively uniform manner.

According to the conventional method disclosed in the Japanese patent publication mentioned earlier, it was difficult to form the ridges accurately at an interval of 90 degrees. However, the present invention does not have such a problem. The pressure that is required for each forming tool is about 2.5 to 4 kN (250 to 400 kg), and the force required to move the work piece in the axial direction is about 300 N (3 kg). Therefore, the device for forming the ridges can be made highly compact, and may be operated even manually without requiring any power source if desired. Therefore, the manufacturing cost and running cost of the device can be minimized.

The foregoing embodiment had the use of a pair of forming tools 5 that are applied to the work piece from above, but it is also possible to use two additional forming tools that are applied to the work piece from below so that four grooves may be formed at the same time. As a matter of fact, the number of forming tools can be freely selected as long as the forming tool or tools can be applied to the work piece as the work piece is moved relative to the forming tool or tools, and each tool is applied to the work piece at a prescribed positional relationship.

Although the present invention has been described in terms of a preferred embodiment thereof, it is obvious to a person skilled in the art that various alterations and modifications are possible without departing from the scope of the present invention which is set forth in the appended claims.

The invention claimed is:

1. A shaft member, comprising:

an axial groove formed on an outer circumferential surface of the shaft member, the groove having a V-shaped cross section taken in a plane perpendicular to an axis of the shaft member;

a first ridge formed on a first side of the axial groove, a peak of the first ridge defining an angle of 90 degrees or smaller; and a second ridge formed on a second side of the axial groove opposite to the first side;

wherein the first ridge has a greater height than the second ridge except in an axial end region.

2. A shaft member as defined in claim 1 comprising a plurality of such axial grooves formed on the outer circumferential surface of the shaft member.

3. A shaft member, comprising:

an axial groove formed on an outer circumferential surface of the shaft member, the groove having a V-shaped cross section;

a first ridge formed on a first side of the axial groove; and a second ridge formed on a second side of the axial groove opposite to the first side, wherein the first ridge has a greater height than the second ridge except in an axial end region, and wherein the first ridge has a more pointed top than the second ridge.

4. A shaft member as defined in claim 3 comprising a plurality of such axial grooves formed on the outer circumferential surface of the shaft member.

5. A shaft member, comprising:

an axial groove formed on an outer circumferential surface of the shaft member, the groove having a V-shaped cross section;

a first ridge formed on a first side of the axial groove; and a second ridge formed on a second side of the axial groove opposite to the first side, wherein the first ridge has a greater height than the second ridge except in an axial end region, and wherein the first ridge has a higher hardness than the second ridge.

6. A shaft member as defined in claim 5 comprising a plurality of such axial grooves formed on the outer circumferential surface of the shaft member.

7. A shaft member, comprising:

an axial groove formed on an outer circumferential surface of the shaft member, the groove having a V-shaped cross section;

a first ridge formed on a first side of the axial groove; and a second ridge formed on a second side of the axial groove opposite to the first side, wherein the first ridge has a greater height than the second ridge except in an axial end region.

8. A shaft member as defined in claim 7 comprising a plurality of such axial grooves formed on the outer circumferential surface of the shaft member.

* * * * *